United States Patent [19]

Kennington et al.

[11] 4,107,053

[45] Aug. 15, 1978

[54] PREPARATION OF THE REACTION PRODUCT OF UREA AND ALKALI METAL HYDROXIDE OR CARBONATE

[75] Inventors: Rowland Kennington; Robin Andrew Woolhouse, both of Runcorn, England

[73] Assignee: Imperial Chemical Industries Limited, London, England

[21] Appl. No.: 737,272

[22] Filed: Nov. 1, 1976

[30] Foreign Application Priority Data

Nov. 14, 1975 [GB] United Kingdom ..... 47040/75

[51] Int. Cl.[2] ..... A62D 1/00

[52] U.S. Cl. ..... 252/2; 252/7; 260/553 CD

[58] Field of Search ..... 252/2, 7; 260/553 CD, 260/555 C; 106/15 FP

[56] References Cited

U.S. PATENT DOCUMENTS

| | | | |
|---|---|---|---|
| 3,484,372 | 12/1969 | Birchall | 252/2 X |
| 3,536,620 | 10/1970 | Birchall | 252/2 X |
| 3,607,744 | 9/1971 | Cottrell | 252/2 X |
| 3,608,641 | 9/1971 | Cottrell | 252/2 X |
| 3,642,621 | 2/1972 | Hollows | 252/2 X |
| 3,776,843 | 12/1973 | Cottrell et al. | 252/2 X |
| 3,947,365 | 3/1976 | Cottrell et al. | 252/7 |

*Primary Examiner*—Leland A. Sebastian

*Attorney, Agent, or Firm*—Cushman, Darby & Cushman

[57] ABSTRACT

A process for the preparation of a fire-extinguishing composition comprising a compound having an empirical formula $MC_2N_2H_3O_3$, where M is potassium or sodium, by reacting a mixture of urea and an alkali selected from hydroxides and carbonic salts of potassium or sodium, the process comprising adding solid particulate urea, or urea and alkali in solid particulate form, to an agitated bed of solid particulate material, the bed of particulate material being heated to a temperature in the range 95° to 200° C and comprising at least alkali in the case where urea alone is added, and the rate of addition of the urea, or of the urea and alkali, being controlled to maintain the bed in a solid particulate form.

16 Claims, 14 Drawing Figures

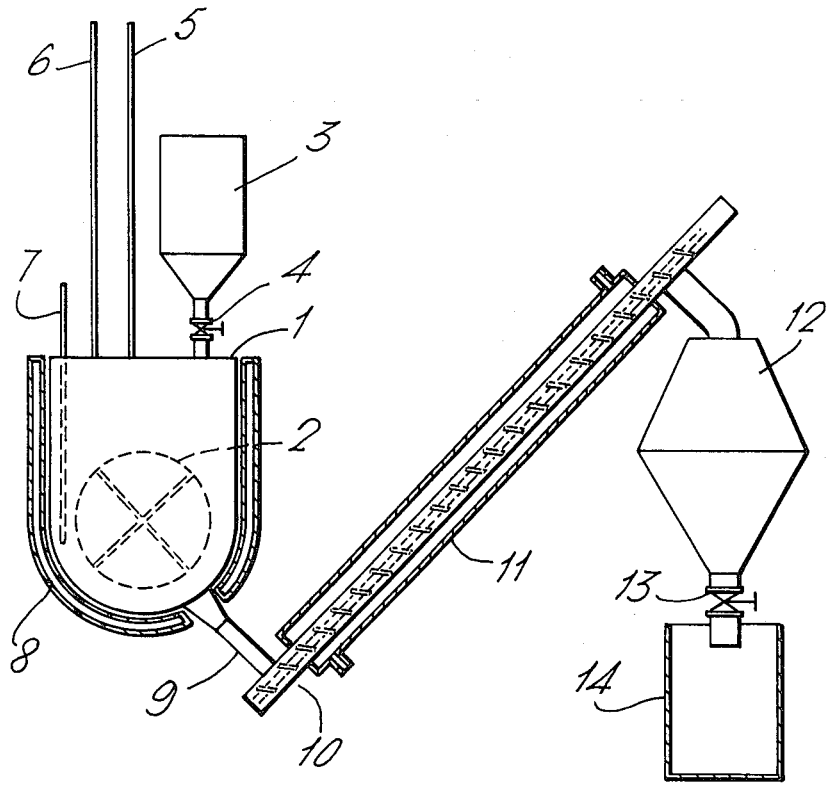
6
5
3
7
4
1
12
2
11
13
8
9
14
10

PREPARATION OF THE REACTION PRODUCT OF UREA AND ALKALI METAL HYDROXIDE OR CARBONATE

This invention relates to a process for the production of a fire-extinguishing compound and to the production of compositions containing the fire-extinguishing compound.

In our British Patent Specification No. 1,168,092 we have described a compound having fire-extinguishing properties, and fire-extinguishing compositions containing the compound. The compound has the empirical formula $MC_2N_2H_3O_3$, where M represents an atom of potassium or sodium, and has infra-red spectral characteristics defined in the aforementioned specification. In this specification we have also described a process for the production of the compound having the empirical formula $MC_2N_2H_3O_3$, and compositions containing the compound, in which a solid mixture of urea and at least one alkali selected from bicarbonates, carbonates, and hydroxides of sodium or potassium is heated at a temperature below 150° C.

In the aforementioned process the mixture of urea and alkali is heated on a tray in an oven and after a suitable period of heating at the desired temperature the product, in the form of a friable cake, is milled to a coarse powder. It is advantageous to heat the mixture in a compacted form, for example in the form of ovoids produced on an indented roll press, as use of such a compacted form results in increased rates of reaction. The heating process is generally repeated in order to increase the yield of the desired compound, and the product of the second heating process is then milled in order to produce a finely-divided free-flowing form suitable for use as a fire-extinguishing composition. The finely-divided form may suitably have a particle size in the range of for example 1 to 250 microns.

As the compound $MC_2N_2H_3O_3$, or a composition containing the compound, must be in a relatively finely-divided and freeflowing particulate form if it is to be suitable for use as a fire-extinguishant it would clearly be desirable to convert a particulate mixture of urea and at least one alkali directly into a free-flowing particulate form of the compound $MC_2N_2H_3O_3$, or composition containing the compound, and thus eliminate the milling stages in the process proposed hitherto. It would also be desirable to eliminate one of the heating stages of the hitherto proposed process.

We have found, however, that when a particulate mixture of urea and at least one alkali is heated the mixture becomes a pasty mass when a temperature in the range 90° C to 100° C is reached, and the product of heating is a lumpy mass which must be extensively milled in order to convert it into a finely-divided form. Even when a particulate mixture of urea and at least one alkali is charged to a reactor and agitated, for example, by tumbling or stirring the mixture as proposed in our British Patent Specification No. 1,315,377, the mixture still becomes pasty and in this case sticks to the walls of the reactor and to the blades of the stirrer. The product of heating is lumpy and does not have the desired finely-divided free-flowing particulate form and must be milled in order to produce this desired form.

We have now found that it is possible to produce a fire-extinguishing compound having the empirical formula $MC_2N_2H_3O_3$, or a fire-extinguishing composition containing the compound, in a finely-divided, free-flowing particulate form directly by heating a particulate mixture of urea and at least one alkali. The process also has the advantage that it can be operated on a continuous or semi-continuous basis.

The present invention provides a process for the preparation of a fire-extinguishing composition comprising a compound having an empirical formula $MC_2N_2H_3O_3$, where M is potassium or sodium, by reacting a mixture of urea and an alkali selected from hydroxides and carbonic salts of potassium or sodium, the process comprising adding solid particulate urea, or urea and alkali in solid particulate form, to an agitated bed of solid particulate material, the bed of particulate material being heated to a temperature in the range 95° C to 200° C and comprising at least alkali in the case where urea alone is added, and the rate of addition of the urea, or of the urea and alkali, being controlled to maintain the bed in a solid particulate form.

The infra-red absorption spectrum of the compound having the empirical formula $MC_2N_2H_3O_3$ is shown in sheets 1 and 2 of our British Patent Specification No. 1,168,092 (where M is potassium) and in sheets 3 and 4 of the specification (where M is sodium).

The carbonic salt may be, for example, a carbonate, a bicarbonate or a sesquicarbonate. Mixtures of carbonic salts may be used as may mixtures of carbonic salts and hydroxides. However, it is preferred to use a bicarbonate as the alkali as the side reactions which may occur when using a bicarbonate are generally less than the side reactions which may occur when other alkalis are used. Furthermore, as some of the alkali may remain as a component of the composition produced by the process of the invention and as some of the alkalis which may be used are hygroscopic and may thus pick up water on standing such that the free-flowing properties of the composition may be impaired on standing, it is preferred to use as alkali one which is at most only slightly hygroscopic. For this reason a bicarbonate is preferred.

The bed of particulate material may comprise a material which is substantially inert to the urea and to the alkali under the reaction conditions and which preferably may be allowed to remain as a component of the fire-extinguishing composition produced by the reaction of urea and alkali when the latter composition is used as a fire-extinguishant. For example the bed of particulate material may comprise a finely-divided silica, e.g. a finely divided sand, or other finely-divided material, e.g. alumina. The bed of particulate material may include a material which imparts free-flowing properties to the composition produced by the reaction of urea and alkali.

Where urea alone is added in a controlled manner to the bed of particulate material then the latter must clearly comprise alkali, and in this case the bed of particulate material suitably comprises a bicarbonate of potassium or sodium. The bed of particulate material may consist essentially of alkali, or it may comprise, for example, a mixture of alkali and an inert material, or preferably a mixture of an alkali and a preformed particulate form of a compound having the empirical formula $MC_2N_2H_3O_3$.

Where both urea and alkali are added to the bed of particulate material the bed may comprise an inert material, or alternatively, or in addition, it may comprise alkali. For example, the bed of particulate material may comprise a bicarbonate of potassium or sodium as such bicarbonates form useful components of fire-extinguishing compositions. In this case, however, it is preferred that the bed of particulate material comprises a preformed particulate form of a compound having the empirical formula $MC_2N_2H_3O_3$, or a mixture thereof with alkali, especially a mixture with a bicarbonate of potassium or sodium. The preformed compound of empirical formula $MC_2N_2H_3O_3$ may be prepared, for example, by the process described in our British Patent Specification No. 1,168, 092.

Where both urea and alkali are added to the bed of particulate material the urea and alkali are suitably in the form of a particulate mixture, and the invention will be described hereinafter, in the case where both urea and alkali are added, with reference to the use of such a mixture.

The rate of addition of the urea or the mixture of urea and alkali to the bed of particulate material should be such as to maintain the bed in particulate form. It should not be so rapid that the bed no longer remains in a particulate form, and in particular it should not be so rapid that the bed assumes a sticky consistency. The rate of addition which can be tolerated in order to maintain the bed in a particulate form will depend inter alia on the degree of agitation of the bed, on the composition of the bed, and on the amount of particulate material in the bed. In general, the greater the degree of agitation the greater will be the rate at which the urea or mixture of urea and alkali can be added whilst maintaining the bed in particulate form. Where the bed contains a relatively small amount of particulate material, for example at the beginning of reaction, the rate of addition of urea or of the mixture of urea and alkali may have to be relatively low. On the other hand, when the bed contains a relatively large amount of particulate material, for example after reaction has been proceeding for some time, the rate of addition of urea or of the mixture of urea and alkali may be correspondingly increased whilst still maintaining the bed in particulate form. It also may be possible to tolerate a higher rate of addition where a mixture of urea and alkali is added to a preformed bed of particulate material containing the compound of empirical formula $MC_2N_2H_3O_3$ than is the case where urea alone is added to a bed of alkali.

Whilst it is not possible to produce precise upper limits to the rates of addition of urea or of a mixture of urea and alkali which must not be exceeded if the bed is to remain in particulate form suitable rates of addition may readily be determined by simple experiment. Furthermore, it is possible to provide examples of suitable rates of addition which have resulted in the production of a suitably particulate form of a fire-extinguishing composition containing the compound of empirical formula $MC_2N_2H_3O_3$. For example, where the bed of particulate material consists of 3 to 6 Kg of a mixture of approximately 75% by weight of compound of empirical formula $KC_2N_2H_3O_3$ and 25% by weight of potassium bicarbonate and agitation of the bed is effected in a reactor containing a plurality of rotating blades we have found that where the rate of addition of a mixture of urea and potassium bicarbonate varies over the range 3 to 6 Kg per hour the bed remains in a suitably particulate form. It is to be understood that these rates of addition are given by way of example only and are in no way limiting.

Addition of the urea or mixture of urea and alkali to the heated bed of particulate material may be made incrementally or continuously. After the addition has been completed it may be desirable to continue the heating of the bed of particulate material in order to increase the proportion of compound having the empirical formula $MC_2N_2H_3O_3$ in the resultant composition. If desired, particulate composition containing the compound having the empirical formula $MC_2N_2H_3O_3$ may be removed incrementally or continuously. Thus, the process of the present invention may comprise incremental or continuous addition of a mixture of urea and alkali, especially a mixture of urea and a bicarbonate of potassium sodium, to a bed of particulate material, especially to a bed comprising a compound having the empirical formula $MC_2N_2H_3O_3$ in a reactor, and incremental or continuous removal of particulate composition containing the compound $MC_2N_2H_3O_3$ from the reactor, for example by means of a screw conveyor.

In the process of the invention the bed of particulate material may be contained in a suitable reactor and agitation of the bed may be effected by means of a stirrer, or preferably a plurality of stirrers, positioned in the reactor. Vigorous agitation of the bed of particulate material is preferred. Alternatively, the bed of particulate material may be a fluidised bed.

In the process of the invention the bed of particulate material is preferably heated to a temperature of at least 100° C and preferably to a temperature not exceeding 170° C. A particularly suitable temperature of the bed of particulate material at which reaction between urea and the alkali is effected is a temperature in the range 100° to 150° C. As the rate of reaction is generally slower with alkalis which are sodium salts than is the case where potassium alkalis are used higher reaction temperatures are favoured where urea is reacted with a sodium alkali.

Urea and alkali are suitably reacted in a proportion of one mole of urea for every 0.25 mole to 2.0 moles of alkali. Thus, when urea is added to a bed of particulate material comprising alkali the proportion of urea which is added to the bed to the alkali which is in the bed is suitably in the above range, and where a mixture of urea and alkali is added to a bed of particulate material then the proportion of urea in the mixture to the total of alkali in the mixture, and alkali in the bed, if any, is suitably in the above range. A preferred range, especially where the alkali is a bicarbonate of sodium or potassium, is one mole of urea for every 0.5 mole to 2.0 moles of alkali.

A more preferred range of urea:alkali is in the range one mole of urea for every 0.75 to 1.25 moles of alkali, especially where the alkali is a bicarbonate of sodium or potassium. Substantially equimolar proportions of urea and alkali are most preferred.

The bed of particulate material should be finely divided and desirably has a mean particle size in the range 1 micron to 1 mm, and similarly the urea and alkali, and mixture of urea and alkali, should also be finely divided and desirably have a mean particle size in the range 1 micron to 1 mm, although particle sizes outside these ranges may be used. For example, the urea alone or in admixture with alkali may suitably have a mean particle size in the range 1 micron to 5 mm, although the mean particle size of the urea may even be outside this range and in particular may be greater than the upper limit of this range.

In a preferred embodiment of the invention the bed of particulate material is contacted with water vapour. Thus, reaction of the urea and alkali is preferably effected in the presence of water vapour. It is found that by effecting the process in this way improved yields of the compound having the empirical formula $MC_2N_2H_3O_3$ are achieved. Suitably the atmosphere in contact with the bed of particulate material contains at least 5% by volume of water vapour, and preferably 5% to 30% by volume of water vapour. The remainder of the atmosphere may be air.

Heating of the bed of particulate material may be continued after addition of the urea or mixture of urea and alkali has been completed in order to improve the yield of compound having the empirical formula $MC_2N_2H_3O_3$, especially when the process is operated as a batch type process. However, it is unnecessary to carry out the process of the invention in such a way as to form the compound $MC_2N_2H_3O_3$ in a substantially pure form. It is preferred, however, that the composition produced by the process of the invention contains 60% by weight or more, and more preferably at least 75% by weight of $MC_2N_2H_3O_3$. In a preferred embodiment potassium or sodium bicarbonate is reacted with urea as these bicarbonates are themselves fire-extinguishants and can advantageously form a part of the composition produced in the process. In this preferred embodiment of the invention the process is effected in such a way as to produce a composition containing 60% by weight or more, and more preferably at least 75% by weight of $MC_2N_2H_3O_3$, and up to 40% by weight, and more preferably not more than 25% by weight, of sodium or potassium bicarbonate. Such preferred compositions may be produced by using an excess of alkali, preferably bicarbonate, over urea in the reaction, or by effecting incomplete reaction between the urea and alkali and removing any unreacted urea from the composition. It is preferred that the composition produced by the process of the invention contains no more than 2% by weight of unreacted urea otherwise the free-flowing properties of the composition may be diminished. Excess urea may be removed from the composition by washing the composition with methanol or by subjecting the composition to steam in order to hydrolyse the urea.

If desired, the compound $MC_2N_2H_3O_3$ may be prepared in a substantially pure form by using in the reaction an excess of urea over the alkali and subsequently removing from the composition the unreacted urea.

Although the composition produced by the process of the invention is in a particulate form, and preferably has a particle size which enables it to be used directly in a fire-extinguishant composition, the composition may if desired be further comminuted, e.g. by ball-milling, before use as a fire-extinguishing composition.

The composition produced by the process of the invention may be mixed with components other than those hereinbefore described. In particular the composition may contain free-flowing agents which aid discharge of the composition from a fire-extinguisher, e.g. finely-divided silica and other finely-divided siliceous materials. The composition may also contain anti-caking agents; calcium hydroxy-phosphate; fatty acids and their salts, e.g. stearic acid and calcium stearate; surface-active agents including foaming agents; water-repelling materials, e.g. silicones; and aditives to give compatibility with fire-fighting foams. Other materials themselves possessing fire-extinguishing or fire-retarding properties or anti-smouldering properties or similar useful abilities to combat combustion may also be associated with the compositions, for example ammonium sulphate, zinc sulphate, phosphates and borates of ammonia, alkali metals, zinc, aluminium and calcium, non-inflammable urea-formaldehyde and phenol/formaldehyde condensation products in powder form, and non-inflammable halogen-containing compounds, for example chlorinated rubber and chlorinated or brominated paraffin wax. These other components may be added to the composition produced by the process of the invention, or they may, in the case where they are substantially inert to the urea and to the alkali under the reaction conditions, form or form part of the bed of particulate material on which the urea and alkali are reacted.

The compositions produced by the process of the invention are particularly useful in extinguishing flames arising from the combustion of liquid and gaseous fuels, e.g. liquid hydrocarbons, hydrogen and methane.

The invention is now illustrated by the following Examples. In Examples 1 and 2 and 4 to 8 the bed of particulate material was contained in a Winkworth Contra Flow Blender (Model No. DB9) comprising a substantially cylindrical trough fitted externally with electrical heating means and having two sets of mixing blades, one set of blades impelling particulate material towards the end plates of the blender and the other set of blades impelling the material towards the centre of the blender thus imparting an intensive mixing action to the particulate material. An atmosphere of water vapour and air in the blender was produced by metering air and water through a flash evaporator and conducting the resultant mixture of air and water vapour to an inlet port on the lid of the blender. The lid of the blender contained an exit port through which gases could be vented. The urea, or mixture of urea and alkali, was fed to the blender through an inlet port on the lid of the blender.

In these Examples the mixture of air and water vapour was passed into the blender when the contents of the blender were at a temperature above 110° C, that is, when the contents of the blender were at a temperature above 110° C during the period of time in which the bed of particulate material was being heated up to the reaction temperature, during the reaction, and, in Examples 1 and 2, during the period in which the contents of the blender were being allowed to cool. In Examples 4 to 8 the contents of the blender were discharged at the reaction temperature and were not allowed to cool in the blender.

EXAMPLE 1

4 Kg of a particulate material comprising 81% by weight of a compound having the empirical formula $KC_2N_2H_3O_3$, 17.2% by weight of $KHCO_3$ and 1.8% by weight of $K_2CO_3$ were charged to the blender. 75% by weight of the particulate material had a particle size in the range 45 microns to 250 microns, 18% by weight a particle size greater than 250 microns, and 7% by weight a particle size less than 45 microns.

The mixture of air (90% by volume) and water vapour (10% by volume) was passed into the blender at a rate of 1670 liters per hour.

The bed of particulate material in the blender was stirred and heated to a temperature of 140° C before beginning addition of an equimolar mixture of urea and potassium bicarbonate. The urea in the mixture comprised 98.5% by weight having a particle size in the range 125 microns to 600 microns and 1.5% by weight having a particle size above 600 microns, and the potassium bicarbonate in the mixture comprised 94.4% by weight having a particle size in the range 45 microns to 250 microns, 3.7% by weight having a particle size above 250 microns, and 1.9% by weight having a particle size below 45 microns. 4 Kg of the mixture was fed to the blender over a period of 30 minutes, the molar ratio of urea:total potassium bicarbonate being 1:1.28.

During the feeding of the mixture of urea and potassium bicarbonate the bed of material in the blender remained particulate and non-sticky and after completion of feeding of the mixture the contents of the blender were agitated and heated for a further 90 minutes at a temperature of 140° C.

The contents of the blender were then allowed to cool and a free-flowing finely divided particulate material was removed from the blender. The material, which was a fire-extinguishant, contained 83% by weight of compound having an empirical formula $KC_2N_2H_3O_3$, 0.8% by weight of $K_2CO_3$, 16.1% by weight of $KHCO_3$ and 0.1% by weight of free urea.

By way of comparison, when an equimolar particulate mixture of urea and potassium bicarbonate was charged to the blender and agitated and heated to a temperature of 135° to 140° C the mixture adhered to the walls of the blender and to the mixing blades of the blender in the form of a soft crust. The material removed from the blender containing 78% by weight of compound having the empirical formula $KC_2N_2H_3O_3$ was in a lumpy form and was not a free-flowing powder.

EXAMPLE 2

The procedure of Example 1 was repeated except that the blender was initially charged with 4 Kg of a particulate material comprising 83% by weight of compound having the empirical formula $KC_2N_2H_3O_3$, 0.3% by weight of free urea, 0.6% by weight of $K_2CO_3$ and 16.1% by weight of $KHCO_3$, and with 2.5 Kg of particulate $KHCO_3$. 1.5 Kg of particulate urea was fed to the blender over a period of 30 minutes, the molar ratio of urea:total $KHCO_3$ thus being 1:1.26. The mixture of air (90% by volume) and water vapour (10% by volume) was passed into the blender at a rate of 1110 liters per hour.

During feeding of the urea the bed of particulate material in the blender remained particulate and non-sticky and after completion of feeding of the urea the contents of the blender were agitated and heated for a further 45 minutes at 140° C.

The free-flowing finely divided particulate material removed from the blender contained 85% by weight of compound having an empirical formula $KC_2N_2H_3O_3$, 0.9% by weight of $K_2CO_3$, 0.1% by weight of free urea and 14% by weight of $KHCO_3$. The particulate material was a fire-extinguishant.

EXAMPLE 3

In this Example an apparatus illustrated diagrammatically in the accompanying drawing was used. The apparatus comprises a Gardener mixer (Series H Model 1200) comprising a trough 1 8 ft long × 3 ft wide fitted internally with a 6-blade stirrer 2 in the form of interrupted spiral. A hopper 3 is positioned above the mixer and a valve 4 controls the flow of material from the hopper to the mixer. A steam line 5 and an air line 6 lead into the mixer and the mixer is fitted with a thermocouple 7 and externally with an electrically-heated blanket 8. Near the base of the mixer an exit port 9 leads to a screw conveyor 10. The screw conveyor 10 is surrounded by a cooling jacket 11 through which water may be passed. The screw conveyor leads to a hopper 12 fitted with a valve 13 and a receptacle 14 for material discharged from the reactor is placed below the hopper.

In operation a bed of particulate material is charged to the mixer 1 via the hopper 3 and the bed is agitated by means of the stirrer 2 and heated by means of the electric blanket 8. Steam and air are passed into the mixer as required. The hopper 3 is charged with urea or a mixture of urea and alkali as required and, when the bed of particulate material is at the required temperature, the contents of the hopper are charged to the mixer in a controlled manner. When reaction has been completed the contents of the mixer are removed via exit port 9 by the screw conveyor 10. If desired, the material removed from the mixer may be cooled during passage through the screw conveyor by passing water through the jacket 11. The contents of the mixer are passed to the hopper 12 and thence to a receptacle 14.

Using the above apparatus the mixer was charged with 400 Kg of a particulate material comprising 83% by weight of a compound having the empirical formula $KC_2N_2H_3O_3$, 0.2% by weight of free urea, 0.7% by weight of $K_2CO_3$ and 16% by weight of $KHCO_3$.

The mixture was agitated and heated to a temperature in the range 140° to 145° C. An equimolar mixture of urea and potassium bicarbonate was then charged to the mixer at a rate of 165 Kg/hour and the temperature of the contents of the mixer was maintained at 108° to 112° C. During addition of the urea/potassium bicarbonate mixture steam was generated by reaction of the urea and potassium bicarbonate and air was passed into the mixture to maintain the concentration of steam in the atmosphere in the mixer at 30% by volume. After 3½ hours addition of the urea/potassium bicarbonate mixture was completed. The molar ratio of urea:$KHCO_3$ was 1:1.14.

The temperature of the contents of the mixer was then raised to 145° C and steam and air were passed into the mixer to maintain in the mixer an atmosphere containing 10% by volume of steam. The contents of the mixer were heated at a temperature of 145° C for 35 minutes in the presence of the steam/air atmosphere and finally for 10 minutes in an atmosphere of air.

The material which was then removed from the mixer was a free-flowing finely divided particulate material containing 82% by weight of compound having the empirical formula $KC_2N_2H_3O_3$, 1.2% by weight of $K_2CO_3$, 16.5% by weight of $KHCO_3$, 0.05% by weight of water, 0.1% by weight of free urea and no detectable potassium cyanate. The material was a fire-extinguishant.

EXAMPLE 4

The procedure of Example 1 was repeated except that the blender was charged initially with 4 Kg of a particulate material comprising a compound of empirical formula $KC_2N_2H_3O_3$, $KHCO_3$ and $K_2CO_3$ as used in Example 1 and with an additional 2.85 Kg of $KHCO_3$, the mixture of air (90% by volume) and water vapour (10% by volume) was passed into the blender at a rate of 800 liters per hour, and 1.15 Kg of urea, in place of the mixture of $KHCO_3$ and urea used in Example 1, was passed into the blender over a period of 20 minutes. The molar ratio of urea:total $KHCO_3$ was thus 1:1.84.

During feeding of the urea the bed of particulate material in the blender remained particulate and non-sticky and after completion of the feeding of the urea the contents of the blender were agitated and heated for a further 60 minutes at 140° C in the presence of the stream of air and water vapour and for a further 10 minutes at 140° C in the absence of the stream of air and water vapour.

A free-flowing finely divided particulate material was then discharged from the blender. The material contained 71% by weight of compound having an empirical formula $KC_2N_2H_3O_3$, 26.8% by weight of $KHCO_3$, 2% by weight of $K_2CO_3$, and 0.2% by weight of free urea. The particulate material was a fire-extinguishant.

EXAMPLE 5

The procedure of Example 4 was followed except that the blender was charged with 2.3 Kg of $KHCO_3$ and 4 Kg of a particulate material comprising a compound of empirical formula $KC_2N_2H_3O_3$, $KHCO_3$ and $K_2CO_3$ as used in Example 1, and 1.71 Kg of urea were passed into the blender over a period of 37 minutes. The molar ratio of urea:total $KHCO_3$ was thus 1:1.05.

The free-flowing finely divided particulate fire-extinguishant discharged from the blender comprised 85.6% by weight of compound having an empirical formula $KC_2N_2H_3O_3$, 11.45% by weight of $KHCO_3$, 0.8% by weight of $K_2CO_3$, and 2.15% by weight of free urea.

EXAMPLE 6

The procedure of Example 4 was followed except that the blender was charged with 2.5 Kg of $KHCO_3$ and with 4 Kg of free-flowing Buckland Sand, and 1.6 Kg of urea were passed into the blender over a period of 40 minutes. The molar ratio of urea:$KHCO_3$ was thus 1:0.9. 76.5% by weight of the sand had a particle size in the range 45 to 250 microns and 23.5% by weight a particle size above 250 microns.

During the feeding of the urea to the material in the blender a small amount of the contents of the blender stuck to the walls of the blender but after the addition of the urea has been completed and the contents of the blender had been heated following the procedure described in Example 4 most of the contents of the blender were discharged as a freeflowing finely divided particulate material.

The material, which was a fire-extinguishant, contained 50% by weight of sand, 37.25% by weight of compound having an empirical formula $KC_2N_2H_3O_3$, 11.2% by weight of $KHCO_3$, 0.8% by weight of $K_2CO_3$ and 0.75% by weight of free urea.

EXAMPLE 7

The procedure of Example 4 was followed except that the blender was charged with 1.74 Kg of $K_2CO_3$ and 4 Kg of a particulate material comprising a compound of empirical formula $KC_2N_2H_3O_3$, $KHCO_3$ and $K_2CO_3$ as used in Example 1, and 2.26 Kg of urea were passed into the blender over a period of 75 minutes. The molar ratio of urea:total $K_2CO_3$ was thus 2.88:1 and the molar ratio of urea:total $K_2CO_3$ plus $KHCO_3$ was 1.88:1.

The free-flowing finely divided particulate fire-extinguishant discharged from the blender comprised 83.3% by weight of compound having empirical formula $KC_2N_2H_3O_3$, 4.5% by weight of free urea, and 12.2% by weight of $K_2CO_3$ plus $KHCO_3$.

EXAMPLE 8

The procedure of Example 4 was followed except that the blender was charged initially with 4 Kg of $NaHCO_3$ (38.7% by weight having a particle size in the range 45 to 125 microns and the remainder a particle size of less than 45 microns), the contents of the blender were agitated and heated at a temperature of 155° C, and 2.61 Kg of urea were added to the blender over a period of 4½ hours. The molar ratio of urea:$NaHCO_3$ was thus 1:1.1. Furthermore, after addition of the urea had been completed the contents of the blender were heated at 155° C in the presence of the stream of air and water vapour for 1 hour, and for a further 10 minutes in the absence of the stream of air and warm vapour.

A free-flowing finely divided particulate fire-extinguishant material was then discharged from the blender. The material contained 54.2% by weight of compound having an empirical formula $NaC_2N_2H_3O_3$, 5.4% by weight of free urea, 37.8% by weight of $NaHCO_3$ and 2.6% by weight of $Na_2CO_3$.

We claim:

1. A process for the preparation of a fire-extinguishing composition comprising a compound having an empirical formula $MC_2N_2H_3O_3$, where M is potassium or sodium, by reacting a mixture of urea and an alkali selected from hydroxides and carbonic salts of potassium or sodium, the process comprising adding solid particulate urea, or urea and alkali in solid particulate form, to an agitated bed of solid particulate material, the bed of particulate material being heated to a temperature in the range 95° C to 200° C and comprising at least alkali in the case where urea alone is added, and the rate of addition of the urea, or of the urea and alkali, being controlled to maintain the bed in a solid particulate form.

2. A process as claimed in claim 1 in which the carbonic salt is a carbonate.

3. A process as claimed in claim 1 in which the carbonic salt is a bicarbonate.

4. A process as claimed in claim 3 in which the carbonic salt is a potassium salt.

5. A process as claimed in claim 1 in which the bed of particulate material comprises a material substantially inert to the urea and to the alkali under the reaction conditions.

6. A process as claimed in claim 5 in which the bed of particulate material comprises sand.

7. A process as claimed in claim 1 in which urea is added to a bed of particulate material which comprises a bicarbonate of potassium or sodium.

8. A process as claimed in claim 1 in which the bed of particulate material comprises a preformed particulate form of the compound having an empirical formula $MC_2N_2H_3O_3$.

9. A process as claimed in claim 1 in which the bed of particulate material has a mean particle size in the range 1 micron to 1 mm.

10. A process as claimed in claim 1 in which the bed of particulate material is heated to a temperature in the range 100° C to 170° C.

11. A process as claimed in claim 1 in which urea and alkali are reacted in a proportion of 1 mole of urea for every 0.25 mole to 2.0 moles of alkali.

12. A process as claimed in claim 11 in which urea and alkali are reacted in a proportion of 1 mole of urea for every 0.75 mole to 1.25 moles of alkali.

13. A process as claimed in claim 1 in which urea and alkali are reacted to produce a fire-extinguishing composition containing 60% by weight or more of compound having the empirical formula $MC_2N_2H_3O_3$.

14. A process as claimed in claim 1 in which the bed of particulate material is contacted with an atmosphere containing water vapour.

15. A process as claimed in claim 14 in which the atmosphere contains 5% to 30% by volume of water vapour.

16. A process as claimed in claim 1 which comprises incrementally or continuously adding urea and alkali to a reactor containing a bed of particulate material and incrementally or continuously removing from the reactor a particulate composition containing a compound having an empirical formula $MC_2N_2H_3O_3$.

* * * * *